US005794581A

United States Patent [19]

Wedel, Jr. et al.

[11] Patent Number: 5,794,581

[45] Date of Patent: Aug. 18, 1998

[54] ENGINE LUBRICATION SYSTEM

[75] Inventors: Raymond B. Wedel, Jr., Elkhart, Ind.; Richard Moser, Santa Ana, Calif.

[73] Assignee: Torque Engineering Corporation, Elkhart, Ind.

[21] Appl. No.: 866,635

[22] Filed: May 30, 1997

[51] Int. Cl.[6] ..... F01M 11/02; F01M 1/16

[52] U.S. Cl. ..... 123/196 R; 123/196 CP; 123/196 S; 184/6.5

[58] Field of Search ..... 123/196 R, 196 S, 123/196 CP; 184/6.5

[56] References Cited

U.S. PATENT DOCUMENTS

| | | | |
|---|---|---|---|
| 2,865,361 | 12/1958 | Leach | 123/196 R |
| 3,014,554 | 12/1961 | Etchells et al. | 123/196 R |
| 3,908,798 | 9/1975 | Binder | 123/196 R |
| 4,512,298 | 4/1985 | Hayashi | 123/196 R |
| 4,852,534 | 8/1989 | Amaral | 123/196 R |
| 5,465,694 | 11/1995 | Agarrat | 123/196 R |

*Primary Examiner*—Erick R. Solis
*Attorney, Agent, or Firm*—Baker & Daniels

[57] ABSTRACT

An engine lubrication system according to the present invention includes a pair of lubrication galleries which extend through the engine block between the ends of the engine crankshaft and communicate with the crankshaft bearing journals through a plurality of lubrication passages. The lubrication galleries are connected to the lubricant pump at opposite ends of the engine. Lubrication passages of one gallery combine with lubrication passages of the other gallery at the crankshaft bearing journals to compensate for the lubricant pressure loss through the galleries with distance from the lubricant pump.

18 Claims, 8 Drawing Sheets

ENGINE LUBRICATION SYSTEM

The present invention relates to a pressurized lubrication system for an engine crankshaft.

BACKGROUND OF THE INVENTION

Conventional engine lubrication systems route lubricant to the crankshaft bearings through one or more lubricant galleries which are communicated to the bearings. Heretofore, such lubricant galleries have been fed by a pump or set of pumps connected to the galleries at one end of the crankshaft. Consequently, lubricant pressure progressively decreases at the bearings along the length of the crankshaft due to principles of flow dynamics. The reduced pressure at the crankshaft bearings farthest from the pump causes increased wear in the crankshaft components and reduces the useful life of the crankshaft and other components of the engine.

SUMMARY OF THE INVENTION

The present invention provides an engine lubrication system for lubricating an engine crankshaft rotatably supported in an engine block. This system includes a pair of lubricant galleries which extend along the length of the crankshaft. Each gallery is fed through an inlet port by a lubricant pump. The inlet port of one gallery is located on one end of the engine, and the inlet port of the other gallery is located on the other end of the engine. As lubricant is pumped through the galleries, passages communicate the lubricant from the galleries to the crankshaft bearings. The passages of one of the galleries cooperate with the passages of the other gallery to provide the lubricant to the bearings along the length of the crankshaft. Lubricant not communicated to the bearings flows through lifter galleries to provide lubricant to the camshaft.

Accordingly it is an object of the present invention to provide an engine lubrication system which routes lubricant to the crankshaft bearings in a manner that compensates for the distance from the oil pump.

BRIEF DESCRIPTION OF THE DRAWINGS

The above-mentioned and other objects and advantages of this invention, and the manner of attaining them, will become more apparent and the invention will be better understood by reference to the following description of embodiments of the invention taken in conjunction with the accompanying drawings wherein.

Figure 1:
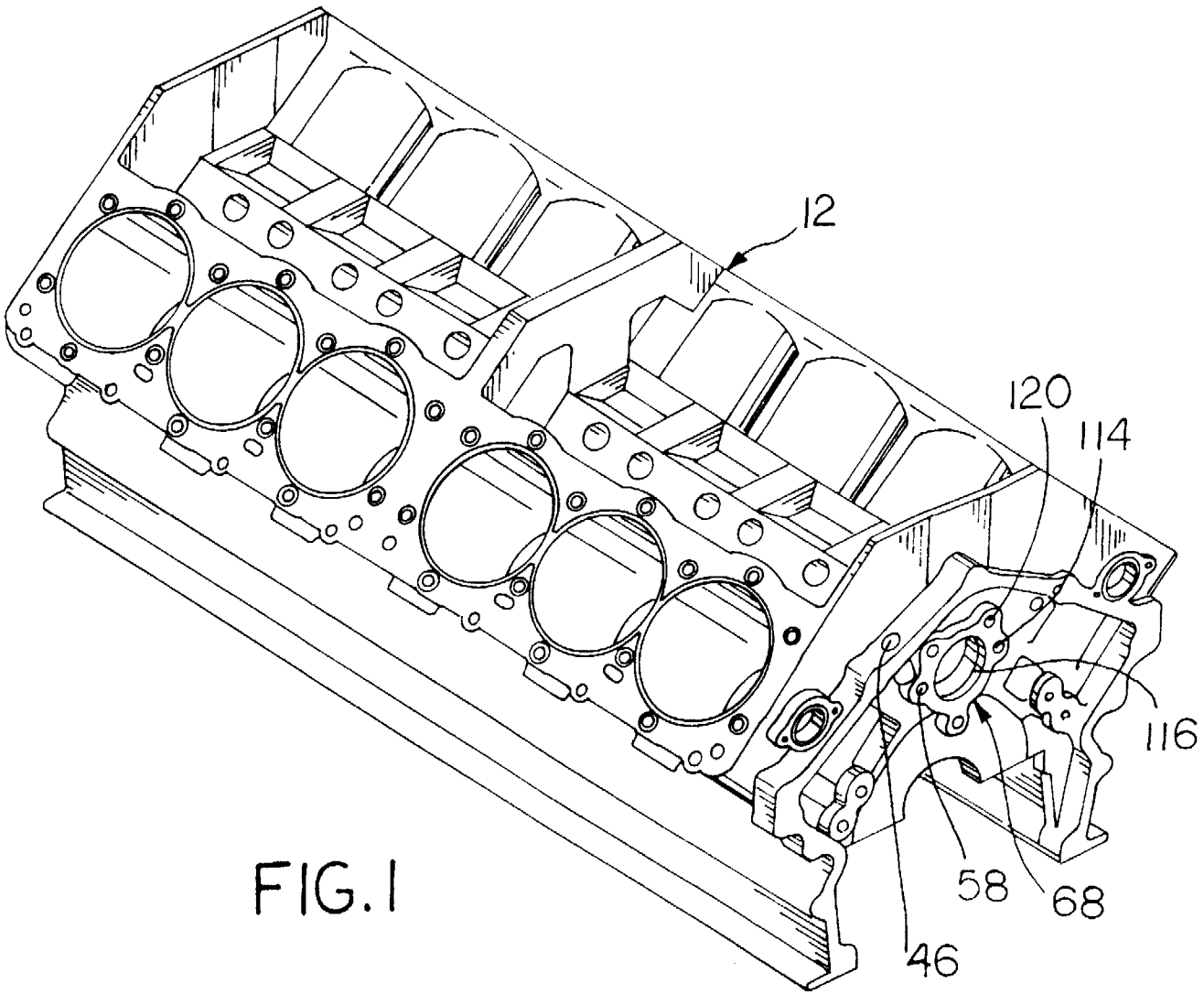
FIG. 1 is a perspective view of the present invention shown in conjunction with an engine block.
Figure 2:
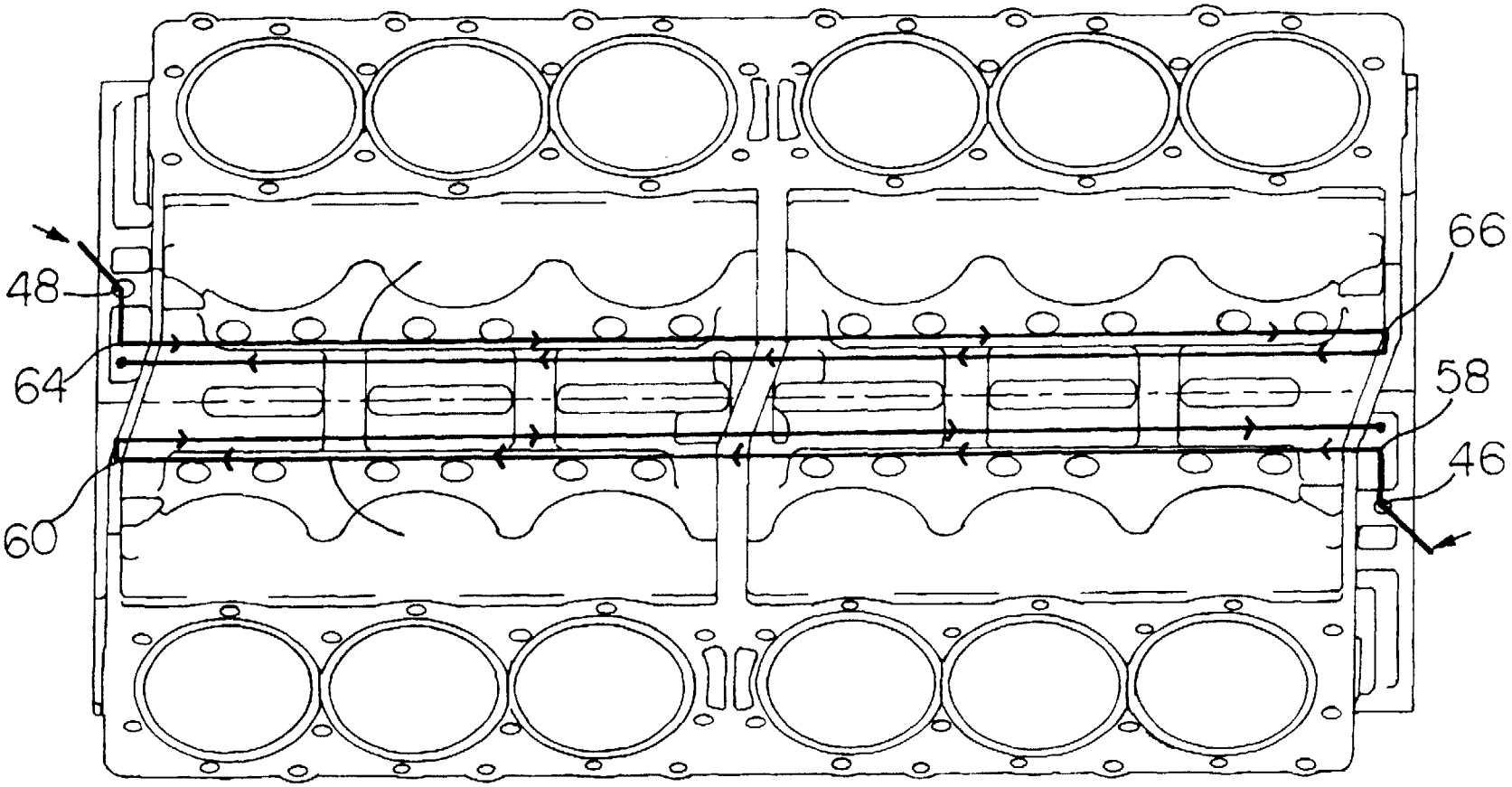
FIG. 2 is a top plan view of the engine of FIG. 1, schematically depicting lubricant flow therethrough.

Corresponding reference characters indicate corresponding parts throughout the several views. Although the drawings represent embodiments of the present invention, the drawings are not necessarily to scale and certain features may be exaggerated in order to better illustrate and explain the present invention.

DETAILED DESCRIPTION OF THE INVENTION

The embodiments disclosed in the detailed description below are not intended to be exhaustive or to limit the invention to the precise forms disclosed. Rather the embodiments selected for the description are disclosed so that others skilled in the art may utilize their teachings.

Figure 6:
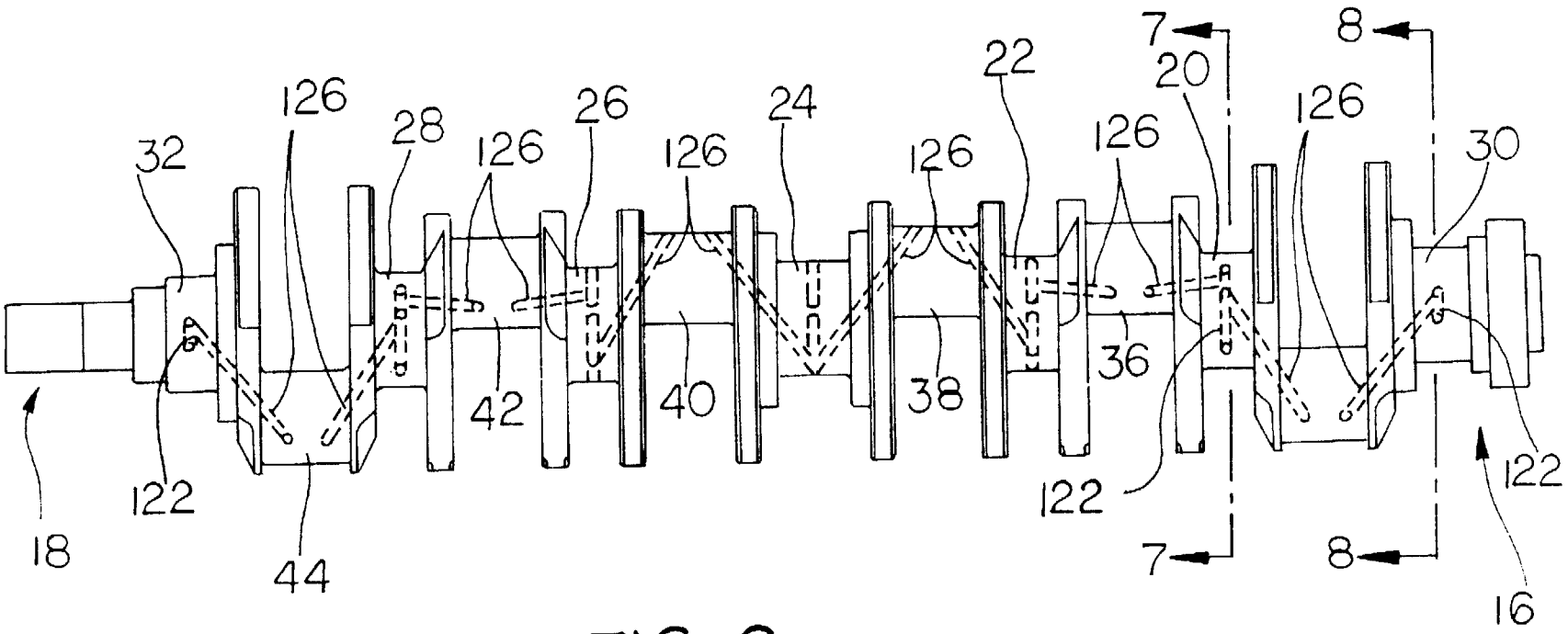
FIG. 6 is a side elevational view of the crankshaft of FIG. 5 illustrating lubricant passages through the crankshaft in broken lines.

FIG. 1 shows a lubrication system of the present invention generally referred to by the numeral 10. System 10 is disposed within engine block 12 which houses crankshaft 14. Crankshaft 14 has one end 16, another end 18, and main bearing journals 20, 22, 24, 26, 28 therebetween. An end bearing journal 30 is located at crankshaft end 16 and end bearing journal 32 is located at crankshaft end 18. A camshaft 15 extends within engine block 12 and is mounted therein for rotation within cam end supports 62, 68. As best shown in FIG. 6, rod bearing journals 34, 36, 38, 40, 42, 44 are located along crankshaft 14 alternately between end bearing journals 30, 32 and main bearing journals 20, 22, 24, 26, 28.

Engine block 12 also includes an inlet port 46 extending into engine block 12 adjacent crankshaft end 16. Another inlet port 48 extends into engine block 12 adjacent crankshaft end 18. A pump 50 (not shown) is located adjacent engine block 12 and connected through plumbing 52 (not shown) to inlet port 46 and inlet port 48. Two main lubrication galleries 54, 56 extend within engine block 12 adjacent to, and in substantially parallel relationship with, crankshaft 14. End 58 of lubrication gallery 54 is in flow communication with inlet port 46 on one end of the engine. End 60 of lubrication gallery 54 communicates with an interior radial groove 106 of end support 62 on the other end of the engine as is described in further detail below. In like manner, end 64 of lubrication gallery 56 is in flow communication with inlet port 48 on the end of the engine opposite from port 46, and end 66 of gallery 56 communicates with an interior radial groove 116 of end support 68 as is described in further detail below.

Figure 4:
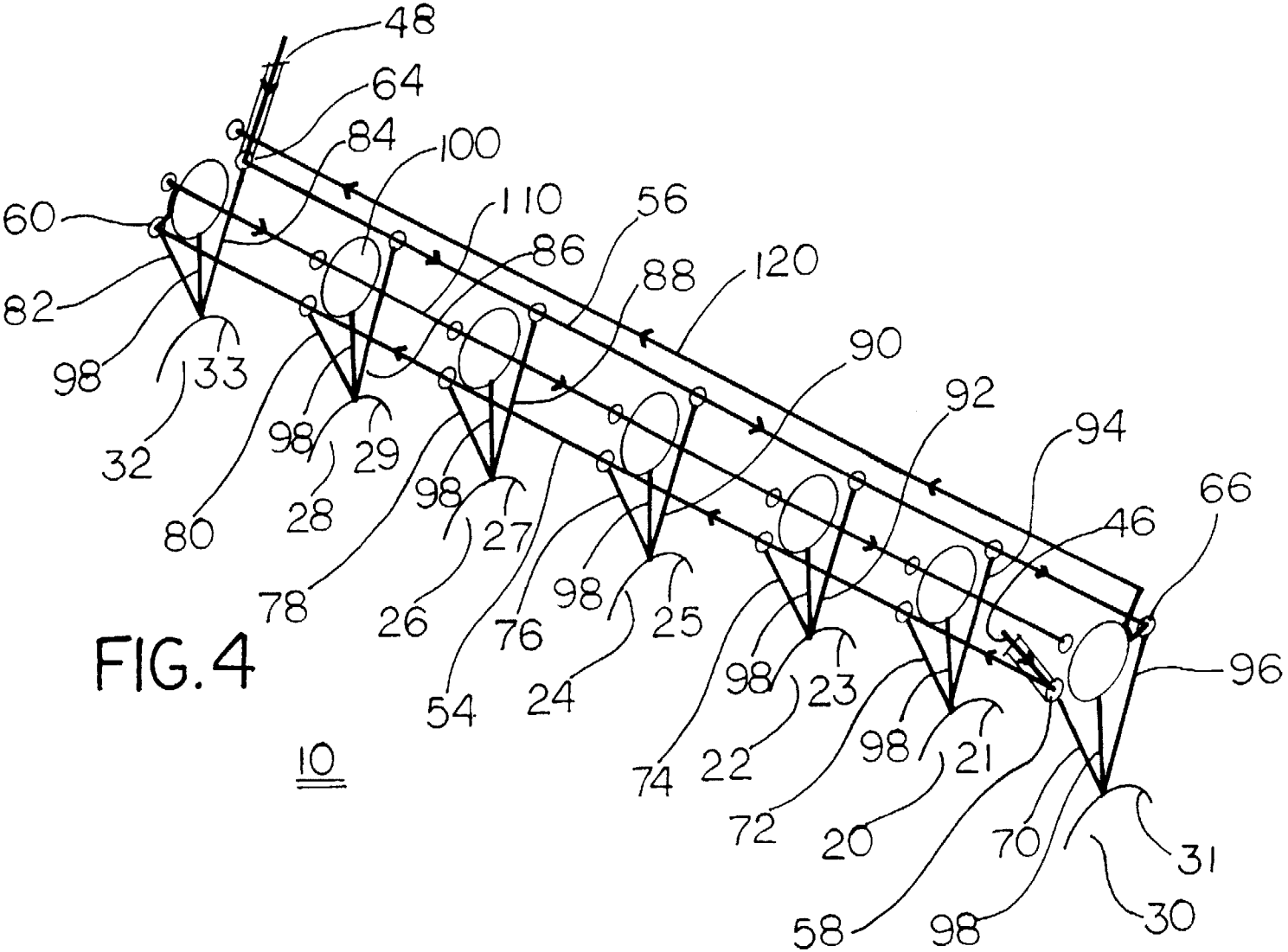
FIG. 4 is a schematic representation of the lubricant flow paths through an engine lubrication system according to the present invention, viewed from above the engine.
Figure 5:
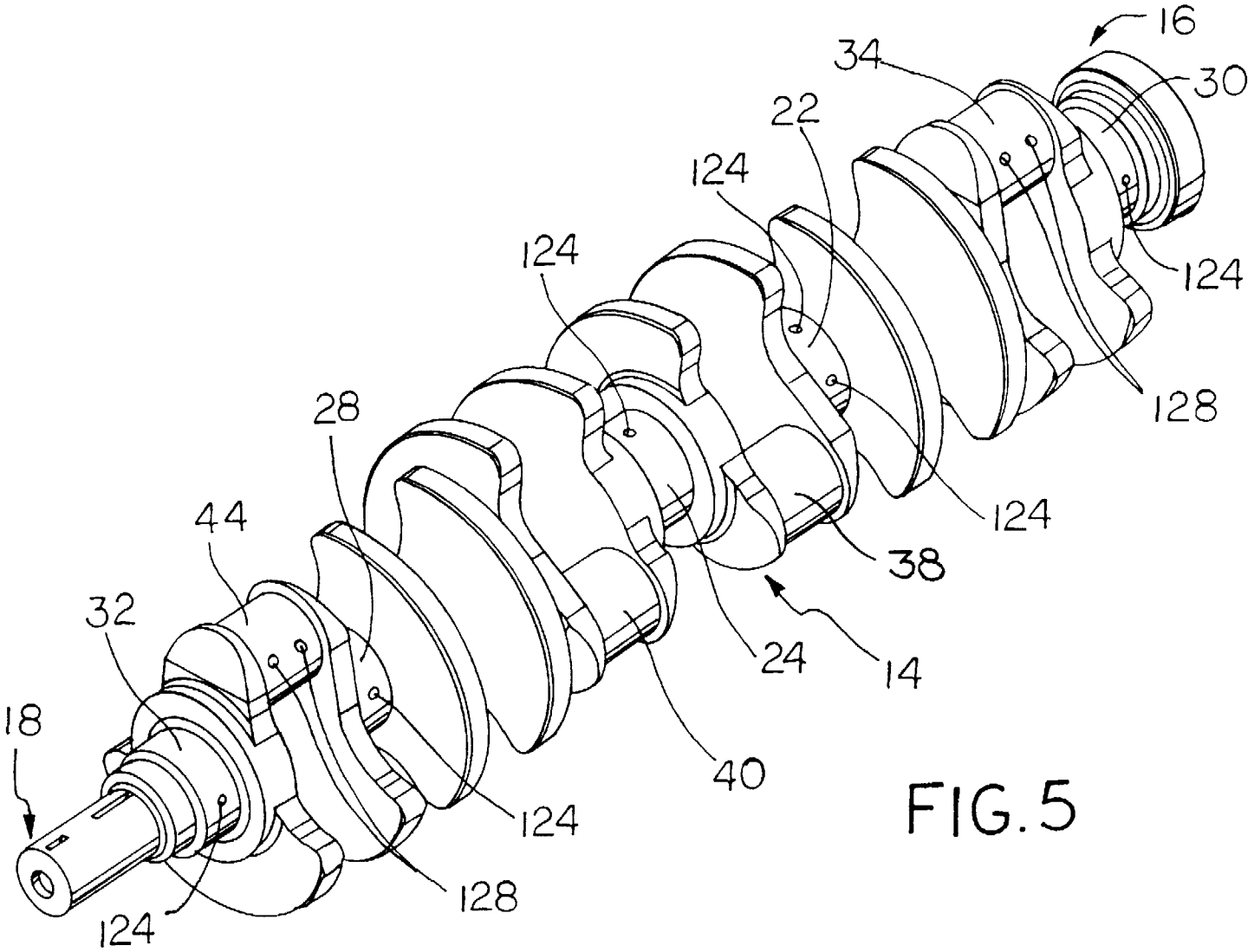
FIG. 5 is a perspective view of a crankshaft used in the engine illustrated in FIGS. 1 through 4.

As best shown in FIG. 4, a plurality of passages 70, 72, 74, 76, 78, 80 and 82 communicate lubrication gallery 54 with end bearing journal 30, main bearing journals 28, 26, 24, 22, 20 and end bearing journal 32, respectively. Passages 84, 86, 88, 90, 92, 94 and 96 communicate lubrication gallery 56 with end bearing journal 32, main bearing journals 20, 22, 24, 26, 28 and end bearing journal 30, respectively. Each pair of passages is also in communication with corresponding vertical cam passages 98 which extends to cam bore 100.

Figure 8:
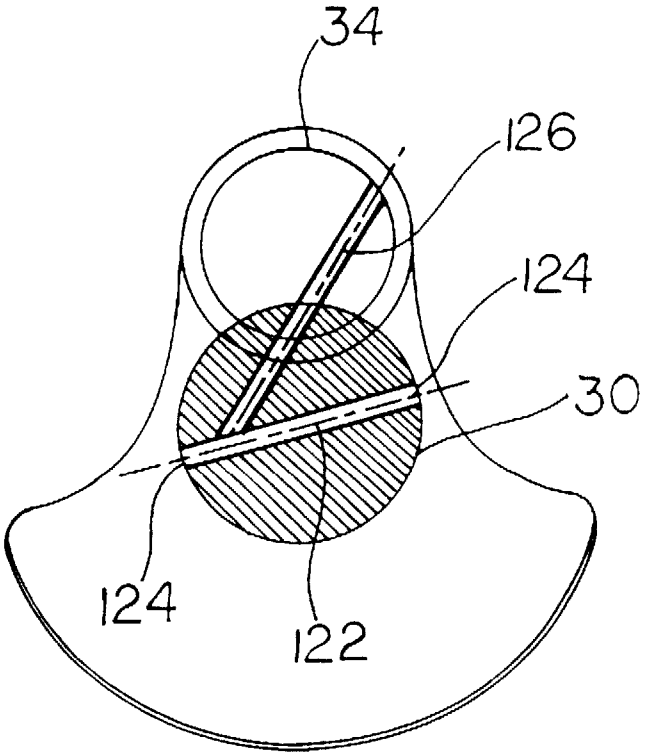
FIG. 8 is a cross-sectional view taken substantially along line 8—8 of FIG. 6.
Figure 7:
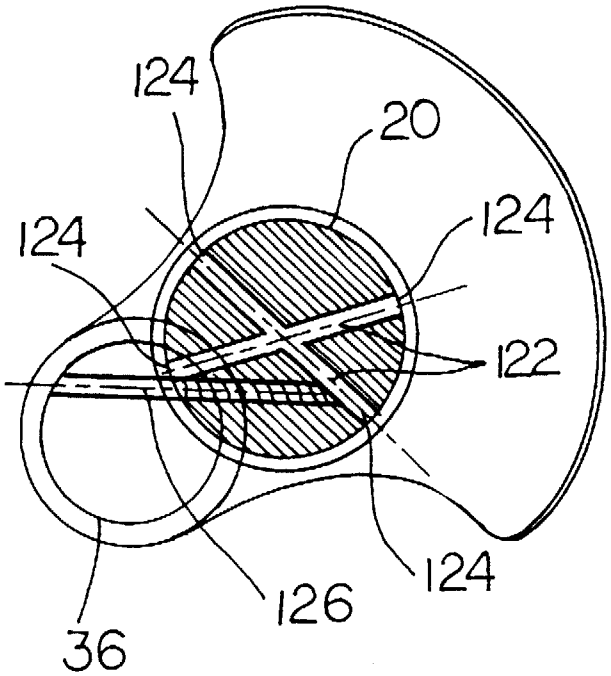
FIG. 7 is a cross-sectional view taken substantially along line 7—7 of FIG. 6.

Referring now to FIGS. 6 through 8, end bearing journals 30, 32 include one distribution passage 122 extending through and substantially bisecting the end bearing. Main bearing journals 20, 22, 24, 26, 28 each include two distribution passages 122 which, as best shown in FIG. 7, intersect within the bearing journal. Each distribution passage has a pair of openings 124 defined by the surface of the bearing journal. As best shown in FIG. 6, passages 122 extending through main bearing journals 20, 22, 24, 26, 28 are in communication with rod passages 126 which extend at an angle to the adjacent rod bearing journals and terminate at openings 128 defined by the surface of the respective rod bearing journal.

Figure 3A:
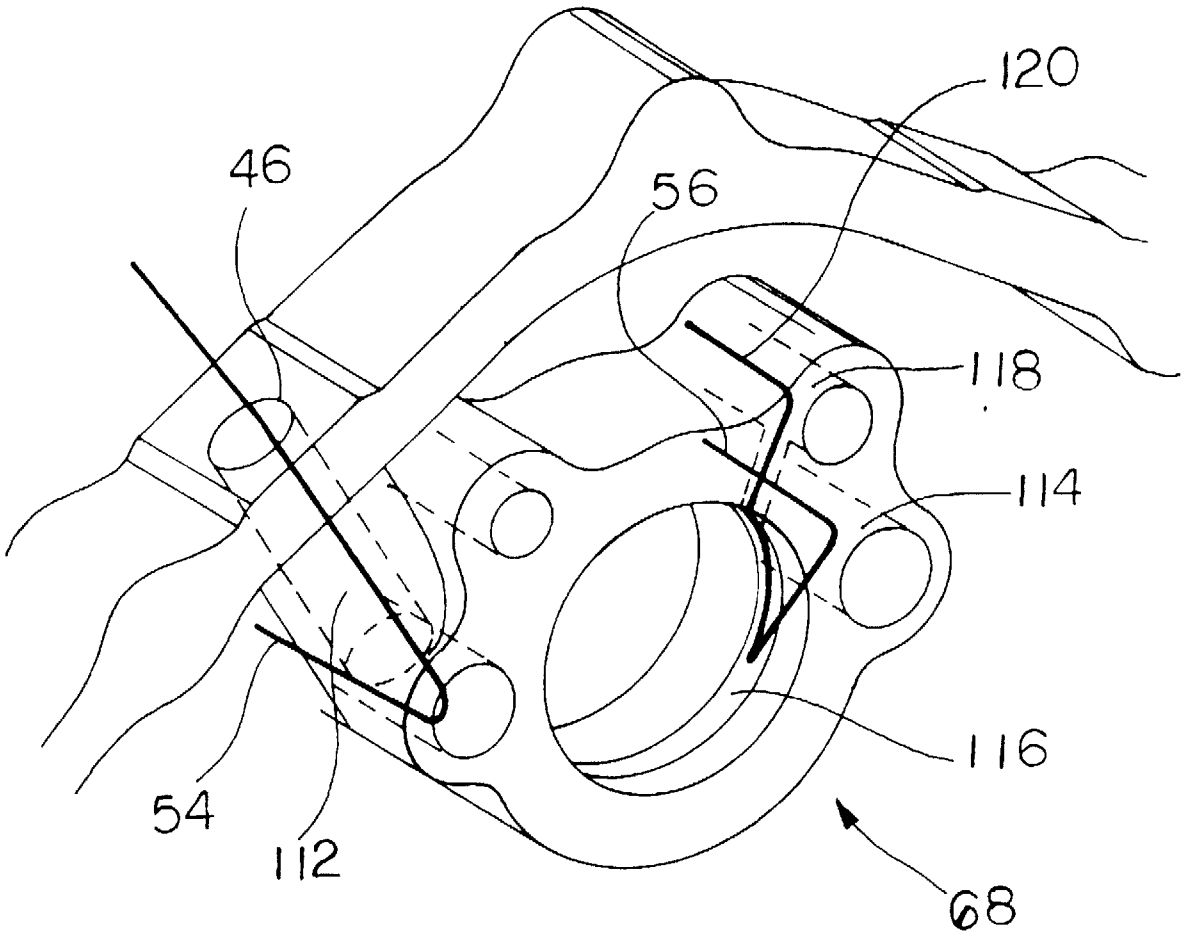
FIG. 3*a* is a partially fragmentary perspective view of a portion of the end of the engine illustrated in FIGS. 1 and 2 in which the camshaft is mounted.
Figure 3B:
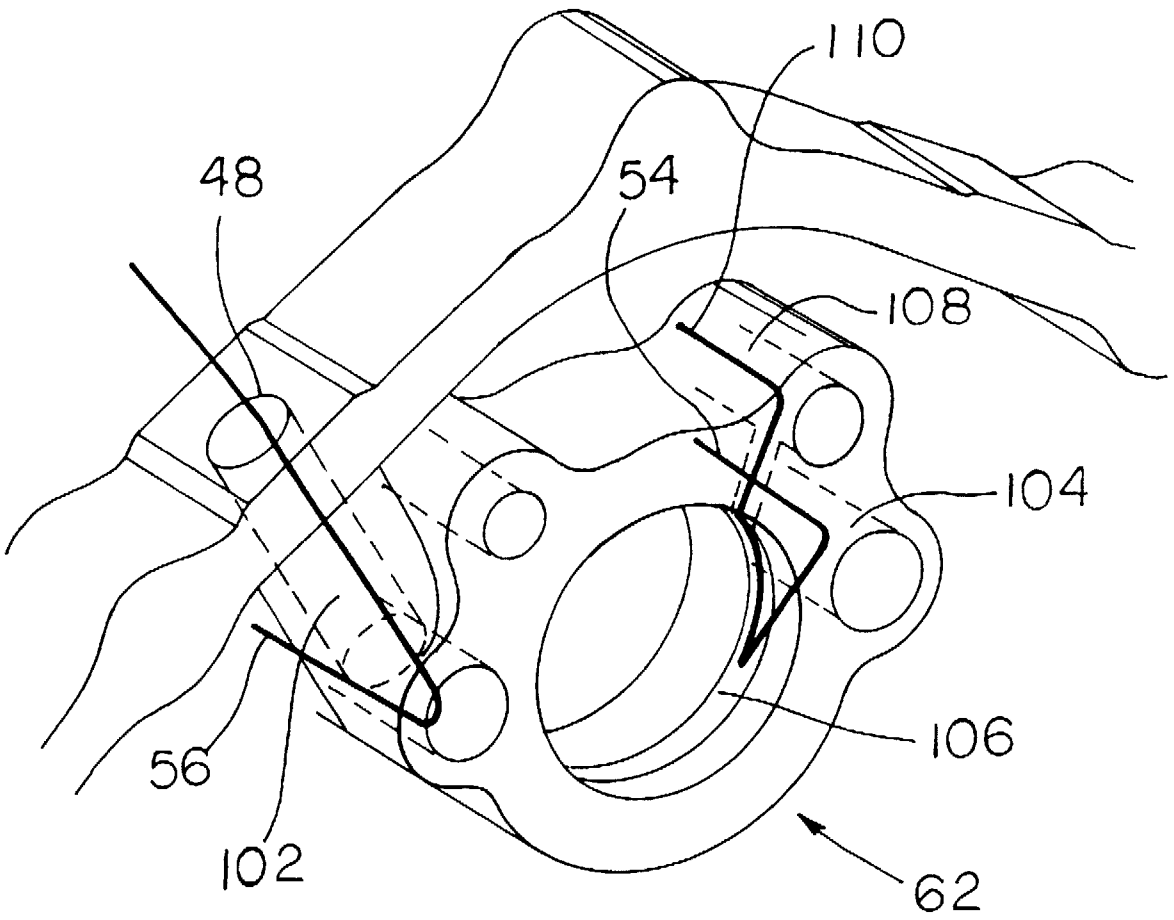
FIG. 3*b* is a partially fragmentary perspective view of a portion of another end of the engine illustrated in FIGS. 1 and 2 in which the camshaft is mounted.

Cam end support 68, shown in FIG. 3a, includes bore 112 which connects inlet port 46 with lubrication gallery 54, and bore 114 which connects gallery 56 to an interior radial groove 116. Interior radial groove 116 is in communication with bore 118 which is connected to lifter gallery 120. Lifter gallery 120 extends through engine block 12 in substantially parallel spaced relationship to main lubrication gallery 56. Likewise, as shown in FIG. 3b, radial lubricant gallery 62 includes a bore 102 which communicates lubrication gallery 56 with inlet port 48, and bore 104 which communicates lubrication gallery 54 with interior radial groove 106 which is connected to bore 108. Bore 108 communicates radial groove 106 with lifter gallery 110 which extends through engine block 12 in substantially parallel spaced relationship to lubrication gallery 54.

Mode of Operation

In operation, pump 50 pumps lubricant through plumbing 52 to inlet ports 46, 48 disposed at opposite ends of engine block 12. Lubricant flowing into inlet port 46 flows through bore 112 of cam end support 68 into lubrication gallery 54. Lubricant entering inlet port 48 flows through bore 102 into lubrication gallery 56. Lubricant fills galleries 54, 56 and communicates through passages 70, 72, 74, 76, 78, 80, 82 and passages 84, 86, 88, 90, 92, 94, 96 to their respective main bearing journals. According to standard principles of fluid dynamics, the pressure through each of the passages communicating through main galleries 54, 56 to bearing journals 20, 22, 24, 26, 28, 30 and 32, depends in part upon the distance between the passage and the pump 50. Lubricant pressure decreases within lubrication gallery 54 along the length of the engine from crankshaft 14 end 58 to end 60. Similarly, lubricant pressure decreases within gallery 56 as it extends in the opposite direction. However, the pairing of passage 82 with 84, passage 80 with 86, passage 78 with 88, passage 76 with 90, passage 74 with 92, passage 72 with 94, and passage 70 with 96 substantially compensates for the decrease in pressure associated with each of the lubrication galleries 54, 56 and results in a lubricant pressure along the length of crankshaft 14 with improved uniformity.

As crankshaft 14 rotates, main bearing journals 20, 22, 24, 26, 28, and end bearing journals 30, 32 rotate within crank saddles 21, 23, 25, 27, 29, 31, and 33 respectively. Lubricant communicated through the paired passages to each of the crank saddles communicates through cam passages 98 to cam bores 100. Lubricant also distributes through main bearing journal distribution passages 122 as crankshaft 14 rotates within the crank saddles 21, 23, 25, 27, 29, 31, 33. As shown in FIG. 7, distribution passages 122 enhance distribution of lubricant about the radius of each main bearing journal by providing radially spaced openings 124 on the bearing journal surface. Lubricant communicated into distribution passages 122 also communicates through rod passages 126 to rod bearing journals 34, 36, 38, 40, 42 and 44. As best shown in FIG. 6, end bearing journals 32, 34 and main bearing journals 20, 22, 24, 26 and 28 cooperate to provide paired rod passages 126, and thus, two sources of lubricant, to each rod bearing journal 34, 36, 38, 40, 42, 44.

After communicating lubricant to each of the crankshaft bearing journals, each lubrication gallery 54, 56 feeds lubricant to a cam end support 62, 68 disposed at the end of each lubrication gallery 54, 56 opposite each respective inlet port 46, 48. End support 62 routes lubricant from lubrication gallery 54 through bore 104 and into interior radial groove 106. The lubricant flows around interior radial groove 106 and into bore 108, where it communicates into lifter gallery 110 as shown in FIG. 3b. Lubricant then communicates through lifter gallery 110 to the engine lifters. Lubricant from lubrication gallery 56 communicates with lifter gallery 120 through cam end support 68 in like fashion as shown in FIG. 3a.

While this invention has been described as having exemplary embodiments, the present invention can be further modified within the spirit and scope of this disclosure. This application is therefore intended to cover any variations, uses, or adaptations of the invention using its general principals. Further, this application is intended to cover such departures from the present disclosure as come within known or customary practice within the art to which this invention pertains and which fall within the limits of the appended claims.

I claim:

1. An engine lubrication system for an engine including an engine block having opposite ends and rotatably supporting a crankshaft having main bearing journals and corresponding rod bearing journals, said crankshaft extending from adjacent one end of the engine block toward the other end of the engine block, said lubrication system comprising:

a pump;

a pair of inlet ports carried by the engine block communicated with said pump;

a pair of lubricant galleries in the engine block extending substantially parallel to the crankshaft; and gallery passages communicating each of the galleries to each of the main bearing journals of the crankshaft.

2. A system according to claim 1 wherein said inlet ports are offset from said ends of the engine block.

3. A system according to claim 1 wherein one said inlet port is disposed adjacent said one end of the engine block and the other said inlet port is disposed adjacent said other end of the engine block.

4. A system according to claim 1 wherein said gallery passages include one set of gallery passages communicating said one lubricant gallery to each of the main bearing journals and another set of gallery passages communicating said other lubricant gallery to each of the main bearing journals.

5. A system according to claim 1 wherein pairs of gallery passages communicate lubricant to each of the main bearing journals, one of said gallery passages of each of said pairs communicating said one lubricant gallery to a corresponding main bearing journal, the other of said gallery passages of each of said pairs communicating said other lubricant gallery to said corresponding main bearing journal.

6. A system according to claim 5 wherein the sum of the distances between said first inlet port and a selected pair of gallery passages and said second inlet port and said selected pair of gallery passages generally equals the distance between said first inlet port and said second inlet port.

7. A system according to claim 5 further comprising distribution passages extending through the main bearing journals, each said distribution passage having openings defined by the surface of the corresponding main bearing journal, said distribution passages communicating lubricant from said gallery passages around said main bearing journal.

8. A system according to claim 7 wherein each said distribution passage communicates a said pair of gallery passages with a plurality of said openings.

9. A system according to claim 8 wherein said plurality of openings are radially spaced about the corresponding main bearing journal.

10. A system according to claim 7 further comprising rod passages communicating said distribution passages with the rod bearing journals.

11. A system according to claim 1 further comprising a pair of lifter galleries in the engine block extending substantially parallel to the crankshaft, one of said lifter galleries extending from said other end of the engine block to said one end of the engine block, the other of said lifter galleries extending from said one end of the engine block to said other end of the engine block, said one lifter gallery being connected to said one lubricant gallery at said other end of the engine block, said other lifter gallery being connected with said other lubricant gallery at said one end of the engine block.

12. A system according to claim 11 further comprising one cam end support disposed adjacent said other end of the engine and another cam end support disposed adjacent said one end of the engine, said one cam end support including an interior radial groove for communicating lubricant from said one lubricant gallery to said one lifter gallery, said other cam end support including an interior radial groove for communicating lubricant from said other lubricant gallery to said other lifter gallery.

13. A lubrication system for distributing lubricant to a crankshaft having opposite ends and bearing journals therebetween, said lubrication system comprising:

a pump;

a pair of lubricant galleries extending substantially parallel to the crankshaft, one of said lubricant galleries having an inlet port adjacent one end of the crankshaft for receiving lubricant from said pump, said one lubricant gallery extending toward the other end of the crankshaft, the other of said lubricant galleries having an inlet port adjacent said other end of the crankshaft for receiving lubricant from said pump, said other lubricant gallery extending toward said one end of the crankshaft;

a first set of gallery passages communicating said one lubricant gallery to each of the bearing journals of the crankshaft; and a second set of gallery passages communicating said other lubricant gallery to each of the bearing journals of the crankshaft;

each gallery passage of said first set of passages being paired with a gallery passage of said second set of passages, each of said pairs of gallery passages communicating lubricant to a bearing journal.

14. A system according to claim 13 wherein the sum of the distances between said one lubricant gallery inlet port and a selected pair of gallery passages and said other lubricant gallery inlet port and said selected pair of gallery passages generally equals the distance between said lubricant gallery inlet ports.

15. A system according to claim 13 further comprising bearing journal passages extending through said crankshaft bearing journals for communicating lubricant from said pairs of gallery passages onto the surfaces of the bearing journals.

16. A system according to claim 15 further comprising rod journal passages communicating said bearing journal passages with the rod bearing journals.

17. A system according to claim 13 further comprising a pair of lifter galleries corresponding to said pair of lubricant galleries, said lifter galleries extending between said one end and said other end of the crankshaft in substantially parallel relationship to said lubricant galleries, and means for communicating lubricant from said lubricant galleries to said corresponding lifter galleries.

18. A system according to claim 17 wherein said communicating means includes a first cam support disposed adjacent said other end of the crankshaft and a second cam support disposed adjacent said one end of the crankshaft, said first cam support including a passage communicating said one lubricant gallery with one of said lifter galleries, said second cam support including a passage communicating said other lubricant gallery with another of said lifter galleries.

* * * * *